US010747251B2

(12) United States Patent
Dooghabadi et al.

(10) Patent No.: US 10,747,251 B2
(45) Date of Patent: Aug. 18, 2020

(54) VOLTAGE REGULATOR

(71) Applicant: Nordic Semiconductor ASA, Trondheim (NO)

(72) Inventors: Malihe Zarre Dooghabadi, Trondheim (NO); Samuli Hallikainen, Trondheim (NO)

(73) Assignee: Nordic Semiconductor ASA, Trondheim (NO)

( * ) Notice: Subject to any disclaimer, the term of this patent is extended or adjusted under 35 U.S.C. 154(b) by 0 days.

(21) Appl. No.: 16/465,123

(22) PCT Filed: Nov. 30, 2017

(86) PCT No.: PCT/GB2017/053608
§ 371 (c)(1),
(2) Date: May 29, 2019

(87) PCT Pub. No.: WO2018/100375
PCT Pub. Date: Jun. 7, 2018

(65) Prior Publication Data

US 2020/0081469 A1 Mar. 12, 2020

(30) Foreign Application Priority Data

Nov. 30, 2016 (GB) ..... 1620334.1

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)

(58) Field of Classification Search
CPC . G05F 1/56; G05F 1/565; G05F 1/575; G05F 1/59; G05F 1/595
See application file for complete search history.

(56) References Cited

U.S. PATENT DOCUMENTS

2006/0164053 A1* 7/2006 Walter ..... G05F 1/575 323/282
2006/0208770 A1* 9/2006 Perez ..... H03F 1/0261 327/108

(Continued)

OTHER PUBLICATIONS

International Search Report and Written Opinion for PCT/GB2017/053608, dated Feb. 6, 2018, 13 pages.

(Continued)

*Primary Examiner* — Gary L Laxton
(74) *Attorney, Agent, or Firm* — Klarquist Sparkman, LLP

(57) ABSTRACT

A low-dropout voltage regulator is arranged to convert an input voltage to an output voltage. The low-dropout voltage regulator comprises: an error amplifier circuit portion arranged to produce an error signal proportional to a difference between a sense voltage (Vsense) and a reference voltage (Vref), wherein the sense voltage is derived from the output voltage; a pass field-effect-transistor (MP) connected to the input voltage; and a rail-to-rail buffer circuit portion connected between the input voltage (VDD) and ground. The rail-to-rail buffer circuit portion comprises: a buffer input arranged to receive the error signal; a buffer output arranged to apply a buffer signal to the gate terminal of the pass field-effect-transistor, wherein the buffer signal is a buffered version of the error signal; and a resistive bypass arrangement (Rbypass) connected between the buffer input and the buffer output.

13 Claims, 2 Drawing Sheets

(56) References Cited

U.S. PATENT DOCUMENTS

| | | | | |
|---|---|---|---|---|
| 2007/0216381 | A1* | 9/2007 | Tsuchiya | G05F 1/575 323/273 |
| 2010/0066320 | A1* | 3/2010 | Dasgupta | G05F 1/575 323/273 |
| 2011/0068758 | A1 | 3/2011 | Chiu | |
| 2013/0113454 | A1 | 5/2013 | Chen et al. | |
| 2013/0285631 | A1* | 10/2013 | Bisson | G05F 1/575 323/280 |
| 2014/0091775 | A1 | 4/2014 | Tan et al. | |
| 2014/0191739 | A1 | 7/2014 | Kim et al. | |
| 2017/0322573 | A1* | 11/2017 | Bhattad | G05F 1/575 |

OTHER PUBLICATIONS

Search Report under Section 17(5) for GB1620334.1, dated Jun. 14, 2017, 3 pages.

* cited by examiner

VOLTAGE REGULATOR

CROSS REFERENCE TO RELATED APPLICATIONS

This is the U.S. National Stage of International Application No. PCT/GB2017/053608, filed Nov. 30, 2017, which was published in English under PCT Article 21(2), which in turn claims the benefit of Great Britain Application No. 1620334.1, filed Nov. 30, 2016.

FIELD

The present invention relates to voltage regulators, particularly low-dropout voltage regulators.

BACKGROUND

Low-dropout (or LDO) voltage regulators are linear DC voltage regulators that are capable of operating with very low input-output differential voltages. The advantages of such regulators with respect to other types of voltage regulators include having a lower minimum operating voltage, higher power efficiency and lower heat dissipation.

A conventional LDO voltage regulator consists of an error amplifier and a pass field-effect-transistor or "pass-FET". The error amplifier compares the output voltage (or a voltage derived therefrom) being generated by the LDO to a reference voltage and alters the conductivity of the pass-FET in order to drive the output voltage to the desired value.

Two important design parameters that must be considered when designing an LDO are the accuracy of the output voltage and the stability of the LDO, As with any circuit, the error amplifier of an LDO regulator has an associated transfer function which describes the frequency response of the circuit. The transfer function typically has a pole located at a particular frequency known as a corner frequency. Once the frequency of the lowest frequency or "dominant" pole has been reached, the gain of the circuit begins to decrease at a rate of 20 dB/decade (i.e. for every ten-fold increase in frequency, the gain drops by 20 dB). Any subsequent poles will then increase this rate by a further 20 dB/decade. Each pole will also introduce a 90 degree phase shift. Thus with two poles, the output is in antiphase (i.e. 180 degrees out of phase) with the input, which can cause the circuit to be unstable. In order for a circuit to be stable, the gain should drop to unity at a frequency lower than that of the second pole (i.e. the first "non-dominant" pole).

In a typical LDO circuit, the first pole is due to a (typically large) output capacitor while the second pole is due to the gate capacitance of the pass-FET. In some conventional LDO regulators a source follower stage is placed at the output of the error amplifier. Such a source follower stage drives the gate of the pass-FET and pushes the second pole to a relatively high frequency with a view to improving the stability of the LDO voltage regulator.

Typically, p-channel metal-oxide-semiconductor (PMOS) field-effect-transistors (pMOSFETs) are the technology of choice for implementing the pass-FET within the LDO in order to achieve a low drop-out voltage. At zero load currents, the gate terminal of the PMOS pass-FET has to be "pulled up" to the supply voltage or to the input voltage $V_{in}$, while at high load currents the gate terminal of the PMOS pass-FET has to be "pulled down" to ground. However, the Applicant has appreciated that there is an issue with these conflicting requirements—an n-channel metal-oxide-semiconductor (NMOS) source follower buffer cannot pull up the gate of the PMOS pass-FET to the supply voltage (or the input voltage $V_{in}$) and a PMOS source follower buffer cannot pull down the gate of the PMOS pass-FET to ground.

When viewed from a first aspect the present invention provides a low-dropout voltage regulator arranged to convert an input voltage to an output voltage, the low-dropout voltage regulator comprising:

- an error amplifier circuit portion arranged to produce an error signal proportional to a difference between a sense voltage and a reference voltage, wherein the sense voltage is derived from the output voltage;
- a pass field-effect-transistor connected to the input voltage;
- a rail-to-rail buffer circuit portion connected between the input voltage and ground, said rail-to-rail buffer circuit portion comprising: a buffer input arranged to receive the error signal; a buffer output arranged to apply a buffer signal to the gate terminal of the pass field-effect-transistor, wherein said buffer signal is a buffered version of said error signal; and a resistive bypass arrangement connected between the buffer input and the buffer output.

At least in preferred embodiments, the present invention provides a low-dropout voltage regulator for which it is not necessary to make a choice between the conflicting requirements referred to above; the pass field-effect-transistor (or "pass-FET") can be pulled both up and down fully depending on whether the load current is high or not. With high load currents that cause the output voltage to drop, the sense voltage will also drop. This drop in the sense voltage may be detected by the error amplifier, and cause the buffer to drive the pass-FET such that additional current flows and increases the output voltage back to the desired level i.e. it may increase until the difference between the sense voltage and the reference voltage is sufficiently low for acceptable operation.

In some embodiments, when the load current is below a threshold, the rail-to-rail buffer circuit portion may be effectively disabled, with the output of the error amplifier being able to drive the pass-FET directly via the resistive bypass arrangement. Thus when the load current is low, the current consumption of the rail-to-rail buffer circuit portion may in some arrangements be kept to a minimum.

The bypass arrangement provides a mechanism for pulling up the gate terminal of the pass-FET. In some embodiments the bypass arrangement comprises a fixed resistor, and in preferred embodiments the fixed resistor is constructed from a field-effect-transistor. While the resistance of the fixed resistor is typically set at a particular value chosen when designing the circuit, it is envisaged that the resistance of the fixed resistor could be variable. Having a variable resistance may provide the benefit of being able to vary an offset of the error amplifier (e.g. by driving the resistance to a high value when the load current is high).

In at least some preferred embodiments the pass field-effect-transistor comprises a p-channel metal-oxide-semiconductor field-effect-transistor (pMOSFET), wherein the source terminal of the pass field-effect-transistor is connected to the input voltage. In some such embodiments, the error amplifier is arranged such that the sense voltage is applied to a non-inverting input of said error amplifier and the reference voltage is applied to an inverting input of said error amplifier. In such embodiments, the error amplifier is arranged to detect if the sense voltage has fallen to the reference voltage and if so decrease its output voltage such that the conductivity of the pMOS pass-FET increases.

However, it will be appreciated that in alternative embodiments, the pass field-effect-transistor comprises an n-channel metal-oxide-semiconductor field-effect-transistor (nMOSFET), wherein the drain terminal of the pass field-effect-transistor is connected to the input voltage. In some such embodiments, the error amplifier is arranged such that the reference voltage is applied to a non-inverting input of said error amplifier and the sense voltage is applied to an inverting input of said error amplifier. In such embodiments, the error amplifier is arranged to detect if the sense voltage has fallen to the reference voltage and if so increase its output voltage such that the conductivity of the nMOS pass-FET increases.

While the output voltage could be compared to the reference voltage directly, in some embodiments the pass field-effect-transistor is connected in series with a potential divider circuit portion comprising at least first and second resistors, wherein the sense voltage comprises the voltage at a node between said first and second resistors. Thus it will be appreciated that in such embodiments the potential divider circuit portion acts as a feedback for the error amplifier. The sense voltage taken from this node will be proportional to the output voltage and will depend on the ratio between the resistance of the first resistor and the resistance of the second resistor. In some embodiments, the resistance of the first resistor and/or the resistance of the second resistor is variable. This provides a way of varying the reference voltage, e.g. by using a programmable resistance that can be varied using a controller.

There are a number of buffer topologies which may be used to implement the rail-to-rail buffer circuit portion described hereinabove, however in some preferred embodiments the rail-to-rail buffer circuit portion comprises:

- an input field-effect-transistor, wherein the buffer input comprises the gate terminal of said input field-effect-transistor;
- an output field-effect-transistor having its source terminal connected to the source terminal of the input field-effect-transistor, and its gate and drain terminals connected to the gate terminal of the pass field-effect-transistor;
- a current source arrangement connected to the source terminals of the input and output field-effect-transistors; and
- a current sink arrangement connected to the drain terminal of the input and output field-effect-transistors.

In preferred embodiments, the input field-effect-transistor comprises a p-channel field-effect-transistor. In some potentially overlapping embodiments, the output field-effect-transistor comprises a p-channel field-effect-transistor.

In some such embodiments, the current source arrangement comprises a current mirror including first and second source mirror field-effect-transistors and a current source, wherein:

- the gate terminal of the first source mirror field-effect-transistor is connected to the drain terminal of the first source mirror field-effect-transistor, the gate terminal of the second source mirror field-effect-transistor, and the current source which is further connected to ground;
- the source terminals of the first and second source mirror field-effect-transistors are connected to the input voltage; and
- the drain terminal of the second source mirror field-effect-transistor is connected to the source terminals of the input and output field-effect-transistors. In a preferred set of such embodiments, said first and second mirror field-effect-transistors comprise p-channel field-effect-transistors.

In some potentially overlapping embodiments, the current sink arrangement comprises first and second sink field-effect-transistors wherein;

- the gate terminal of the first sink field-effect-transistor is connected to the drain terminal of the first sink field-effect-transistor, the gate terminal of the second sink field-effect-transistor, and the drain terminal of the input field-effect-transistor;
- the drain terminal of the second sink field-effect-transistor is connected to the drain and gate terminals of the output field-effect-transistor and the gate terminal of the pass field-effect-transistor. In a preferred set of such embodiments, said first and second sink field-effect-transistors comprise n-channel field-effect-transistors.

The first and second sink field-effect-transistors should be connected to a sufficiently low voltage in order to pull down the gate terminal of the pass-FET. In a preferred set of embodiments, the source terminals of the first and second sink field-effect-transistors are connected to ground.

While it will be appreciated that there are a number of different arrangements suitable for implementing an error amplifier known in the art per se, in some preferred embodiments the error amplifier comprises an operational amplifier. Operational amplifiers or "op-amps" are DC-coupled, high gain voltage amplifiers typically provided with a differential input and a single-ended output, wherein the voltage at the output is proportional to a difference between the voltages presented at the differential input. The actual gain of the op-amp will depend on any negative bypass arrangement together with the specific topology of the circuit in which the op-amp is being used.

DESCRIPTION OF DRAWINGS

Certain embodiments of the invention will now be described, by way of example only, with reference to the accompanying drawings in which.

DETAILED DESCRIPTION

Figure 1:
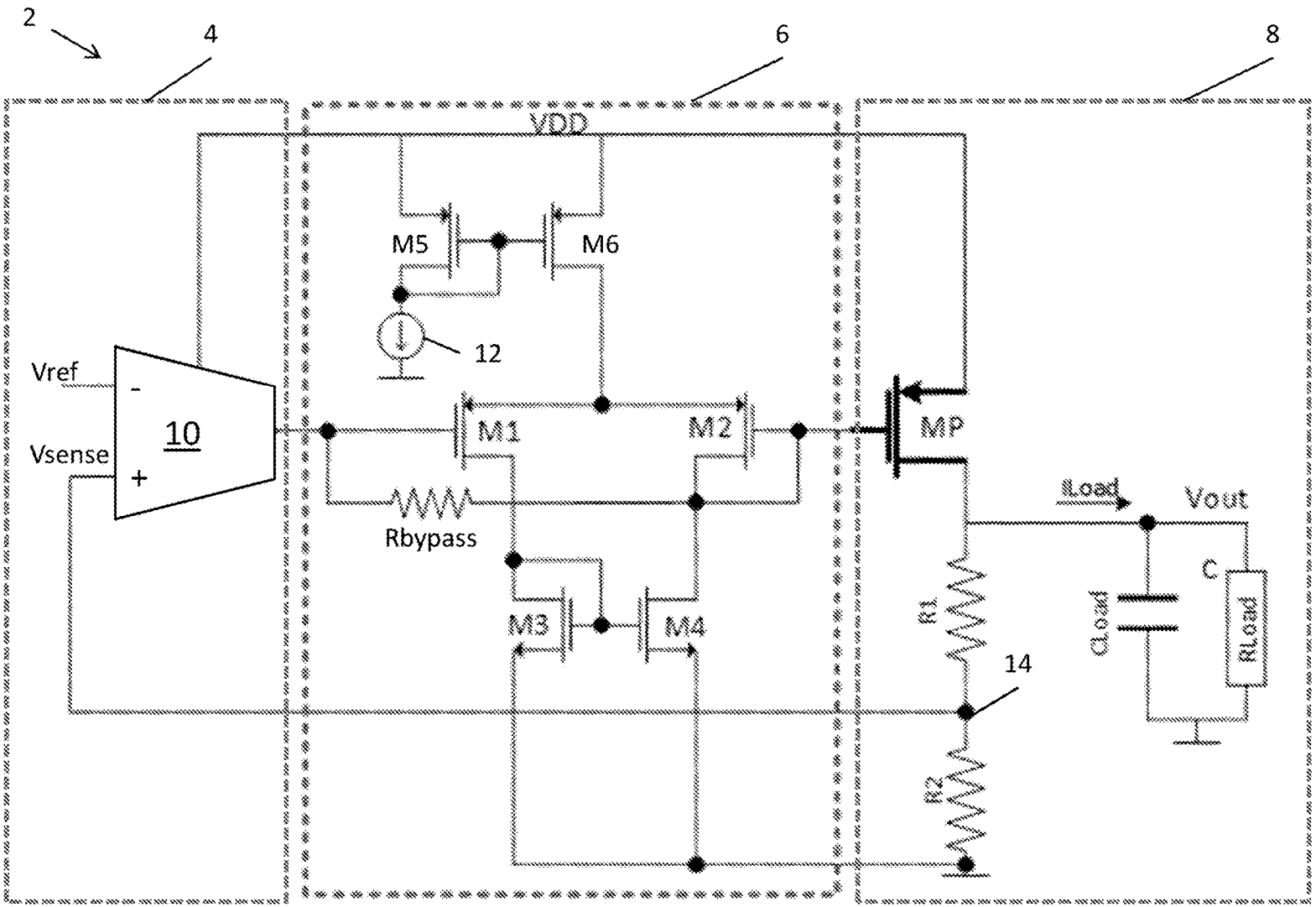
FIG. 1 shows a circuit diagram of a low-dropout voltage regulator in accordance with an embodiment of the present invention.

FIG. 1 shows a circuit diagram of a low-dropout (LDO) voltage regulator 2 in accordance with an embodiment of the present invention. The LDO voltage regulator 2 comprises: an error amplifier circuit portion 4; a rail-to-rail buffer circuit portion 6; and an output circuit portion 8. It will be appreciated that the LDO voltage regulator 2 will typically be implemented as a single integrated circuit, however the LDO voltage regulator 2 has been divided up into these functional circuit portions for ease of reference.

The error amplifier circuit portion 4 comprises a differential operational amplifier 10 arranged such that its inverting input is connected to a reference voltage Vref and its non-inverting input is connected to a voltage produced by the output circuit portion 8 as will be described in further detail below. The output of the op-amp 10 is connected to the input of the rail-to-rail buffer circuit portion 6 as will also be described later.

The rail-to-rail buffer circuit portion 6 comprises: a p-channel buffer input, metal-oxide-semiconductor field-effect-transistor (pMOSFET) M1: a buffer output pMOSFET M2; a current sync arrangement constructed from two n-channel metal-oxide-semiconductor field-effect-transistors (nMOSFETs) M3 and M4; and a current source arrangement constructed from a current source 12 and two pMOSFETs M5 and M6.

The source terminals of the input pMOSFET M1 and the output pMOSFET M2 are connected to the drain terminal of pMOSFET M6 within the current source arrangement. The source terminal of M6 is connected to the input voltage VDD and its gate terminal is connected to both the gate terminal and the drain terminal of M5. The drain terminal of M5 is further connected to the current source 12 which is in and connected to ground. The source terminal of M5 is connected to the input voltage VDD.

The output of the op-amp 10 in the error amplifier circuit portion 4 is connected to the gate terminal of M1 directly and to the gate and drain terminals of M2 via a bypass resistor Rbypass. The gate and drain terminals of M2 are further connected to the gate terminal of a pass field-effect-transistor or "pass-FET" as will be described in further detail below. The drain terminal of M1 is connected to the drain terminal of M3 and to the gate terminals of both M3 and M4. The gate and drain terminals of M2 are connected to the drain terminal of M4. The source terminals of both M3 and M4 are connected to ground.

The output circuit portion 8 comprises: the pass-FET MP; a potential divider network constructed from first and second resistors R1 and R2; and an output to which a load CLoad, RLoad is connected.

In this particular embodiment the pass-FET MP comprises a pMOSFET and is arranged such that its source terminal is connected to the input voltage VDD, its gate terminal is connected to the gate and drain terminals of M2 within the buffer circuit portion 6, and its drain terminal is connected to one side of the resistor R1. The output voltage Vout is taken from the drain terminal of the pass-FET MP. The voltage and the node 14 between resistors R1 and R2 is connected to the non-inverting input of the op-amp 10.

Figure 2:
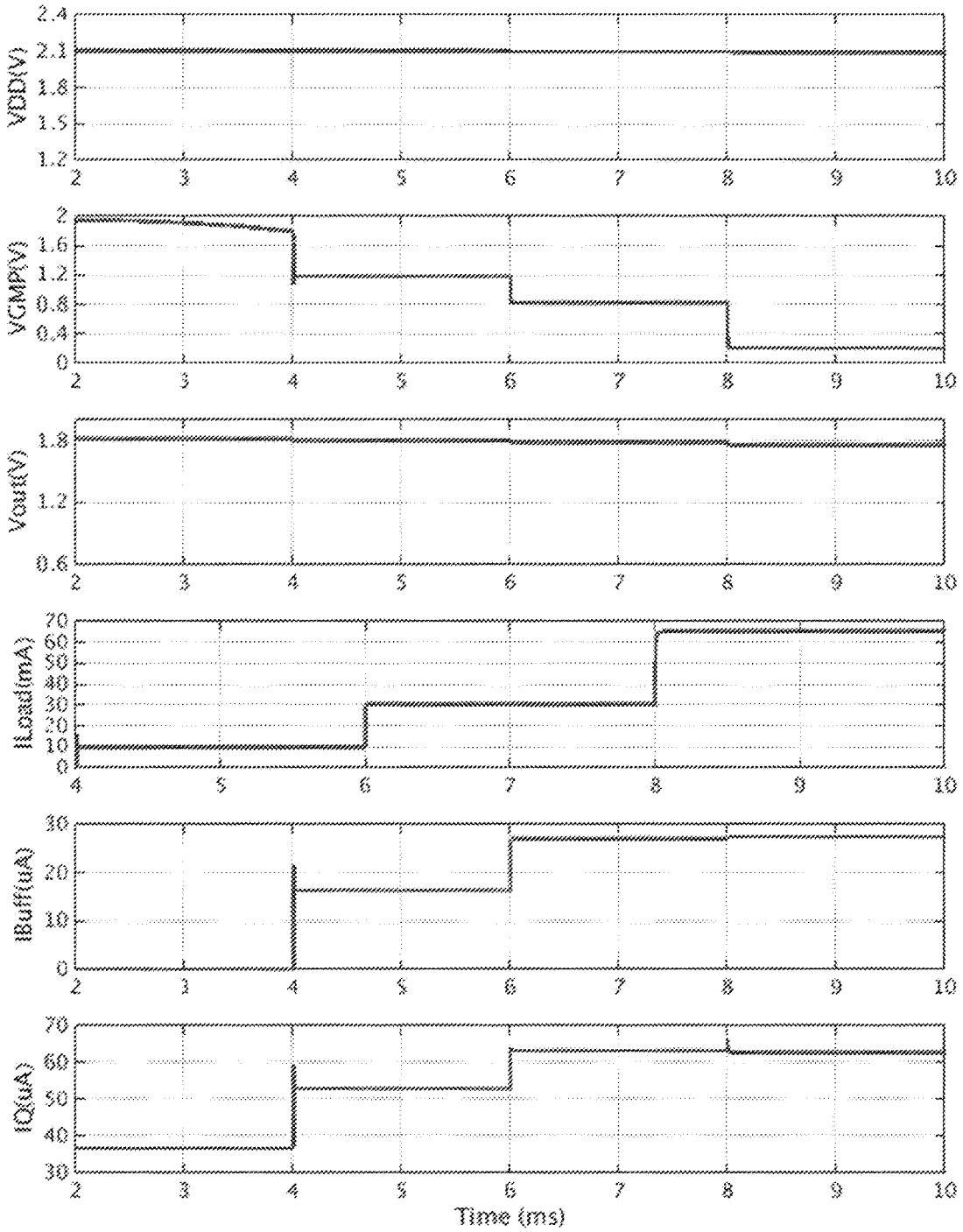
FIG. 2 shows a graph of various voltages and currents at nodes of regulator of FIG. 1 under different load currents.

The operation of the LDO voltage regulator 2 will now be described with reference to FIG. 2 in which the values of various voltages and currents at nodes of the LDO voltage regulator 2 under different values of the load current ILoad are shown. In particular, FIG. 2 shows: the value of the input voltage VDD; the voltage VGMP at the gate terminal of the pass-FET MP; the output voltage Vout; the load current ILoad; the bias current IBuff provided to the rail-to-rail buffer circuit portion 6; and the quiescent current IQ.

If the load current ILoad is 0 A, e.g. the load, RLoad, CLoad is disconnected, or if the load current ILoad is relatively small, then the output voltage Vout is likely to be at its desired value. The sense voltage Vsense taken from the node 14 between R1 and R2 (and thus dependent on the output voltage Vout) is compared to the reference voltage Vref by the op-amp 10 which determines that the sense voltage Vsense is sufficiently greater than the reference voltage Vref and so outputs a voltage sufficiently high that when applied to the gate terminal of the pass-FET MP via the bypass resistor Rbypass, it causes the conductivity of the pass-FET MP to take a value such that the output voltage Vout is maintained at the desired level. There is the added benefit that as the pass-FET MP is in the subthreshold region and M5 and M6 are in the triode region, the increased voltage at the output of the op-amp 10 is sufficient to disable M1 and M2 (i.e. to drive them to the subthreshold region), preventing any bias current IBuff flowing through the buffer circuit portion 6 thus reducing the quiescent current IQ (and the overall current consumption) of the LDO voltage regulator 2 (i.e. contributions to the quiescent current of the LDO voltage regulator 2 come only from the op-amp 10 and no contributions come from the buffer circuit portion 6), Typically connecting the output of the op-amp 10 direct to the gate of the pass-FET MP does not have any negative impact on the stability of the system under low load conditions as the dominant pole will be at a relatively low frequency.

Under a moderate load, the pass-FET MP is driven into the active region, M5 and M6 are in the triode region, and M1 and M2 are in the active region. The quiescent current in the buffer circuit portion 6 depends on the "matching" between the pass-FET MP and M2 (i.e. the ratio between the sizes of MP and M2) and the output current flowing from the pass-FET MP (which is linked to the thresholds of MP and M2). The output current produced by the buffer circuit portion 6 adapts to the load current Load, until M5 and M6 transitions from the triode region to the active region as will be described below.

If a sufficiently large load RLoad, CLoad is connected to the output of the LDO voltage regulator 2, the load current ILoad will increase and the outlet voltage Vout will begin to drop. This will also cause the voltage Vsense taken from the node 14 between R1 and R2 to drop and the difference between Vsense and Vref will decrease thus reducing the output voltage of the op-amp 10, This reduced voltage at the output of the op-amp 10 causes the transistor M1 to begin conducting and thus a current flows through M1 and subsequently through M3 to ground. As M3 and M4 comprise a current mirror the same current flows through M4 which is connected to the gate terminal of the pass-FET MP. The voltage VGMP applied to the gate terminal of the pass-FET MP pulls the gate of the pass-FET MP down to ground, increasing its conductivity and allowing a higher current to flow through the pass-FET MP. This increase in conductivity of the pass-FET MP provides the required increase in load current ILoad which in turn increases the output voltage Vout in accordance with Ohm's law. Thus under high load current ILoad, the pass-FET MP is driven in the triode region while M1, M2, M5 and M6 are in the active region. The output resistance of the buffer circuit portion 6 increases because the impedance of the current source arrangement is high (due to M5 and M6 being in the active region) and the effective resistance as seen by the gate terminal of the pass-FET MP is the sum of the resistances of: M2 (i.e. $1/g_m$ of M2) and the drain-source resistance of M4 in parallel with the effective resistance of the current source arrangement. This increase in the output impedance of the buffer circuit portion 6 can be tolerated because the operation of the pass-FET MP moves towards the triode region and the loop gain is reduced and thus the LDO voltage regulator 2 remains stable.

As can be seen from FIG. 2, stepping up the load current ILoad has the effect of decreasing the output voltage Vout, which in turn reduces the voltage VGMP applied to the gate terminal of the pass-FET MP as described previously. While marginal, increasing the load current ILoad may typically cause a slight drop in the input voltage VDD due to the finite internal resistance of the voltage supply. It can also be seen that increasing the load current ILoad drives additional bias current IBuff to the rail-to-rail buffer circuit portion 6, enhancing its ability to pull down the gate terminal of the pass-FET MP. Of course, increasing the bias current IBuff provided to the rail-to-rail buffer circuit portion 6 increases the quiescent current IQ (and thus the overall current consumption) of the LDO voltage regulator 2.

Thus it will be seen that embodiments of the present invention provide an improved low drop out voltage regulator arranged such that the pass-FET can be pulled fully up or down as required by a rail-to-rail buffer. It will be appreciated by those skilled in the art that the embodiments described above are merely exemplary and are not limiting on the scope of the invention.

The invention claimed is:

1. A low-dropout voltage regulator arranged to convert an input voltage to an output voltage, the low-dropout voltage regulator comprising:

an error amplifier circuit portion arranged to produce an error signal proportional to a difference between a sense voltage and a reference voltage, wherein the sense voltage is derived from the output voltage;

a pass field-effect-transistor connected to the input voltage; wherein said pass field-effect-transistor comprises a gate terminal, a source terminal, and a drain terminal; and a rail-to-rail buffer circuit portion connected between the input voltage and ground, said rail-to-rail buffer circuit portion comprising: a buffer input arranged to receive the error signal; a buffer output arranged to apply a buffer signal to the gate terminal of the pass field-effect-transistor, wherein said buffer signal is a buffered version of said error signal; and a resistive bypass arrangement connected between the buffer input and the buffer output;

wherein the rail-to-rail buffer circuit portion further comprises:

an input field-effect-transistor comprising a gate terminal, a source terminal, and a drain terminal, wherein the buffer input comprises the gate terminal of said input field-effect-transistor;

an output field-effect-transistor, comprising a gate terminal, a source terminal, and a drain terminal; where the source terminal of said output field-effect-transistor is connected to the source terminal of the input field-effect-transistor, and the gate and drain terminals of said output field-effect-transistor are connected to the gate terminal of the pass field-effect-transistor;

a current source arrangement connected to the source terminals of the input and output field-effect-transistors; and a current sink arrangement connected to the drain terminal of the input and output field-effect-transistors;

wherein the low-dropout voltage regulator is configured to disable the rail-to-rail buffer circuit portion when the load current is below a threshold such that the output of the error amplifier drives the pass field-effect-transistor directly via the resistive bypass arrangement.

2. The low-dropout voltage regulator as claimed in claim 1, wherein the bypass arrangement comprises a fixed resistor.

3. The low-dropout voltage regulator as claimed in claim 1, wherein the pass field-effect-transistor comprises a p-channel metal-oxide-semiconductor field-effect-transistor, and wherein the source terminal of the pass field-effect-transistor is connected to the input voltage.

4. The low-dropout voltage regulator as claimed in claim 3, wherein the error amplifier is arranged such that the sense voltage is applied to a non-inverting input of said error amplifier and the reference voltage is applied to an inverting input of said error amplifier.

5. The low-dropout voltage regulator as claimed in claim 1, wherein the pass field-effect-transistor is connected in series with a potential divider circuit portion comprising at least first and second resistors, and wherein the sense voltage comprises a voltage at a node between said first and second resistors.

6. The low-dropout voltage regulator as claimed in claim 1, wherein the input field-effect-transistor comprises a p-channel field-effect-transistor.

7. The low-dropout voltage regulator as claimed in claim 1, wherein, the output field-effect-transistor comprises a p-channel field-effect-transistor.

8. The low-dropout voltage regulator as claimed in claim 1, wherein the current source arrangement comprises a current mirror including first and second source mirror field-effect-transistors and a current source, wherein:

the first and second source mirror field-effect-transistors each comprise a gate terminal, a source terminal, and a drain terminal; and the gate terminal of the first source mirror field-effect-transistor is connected to the drain terminal of the first source mirror field-effect-transistor, the gate terminal of the second source mirror field-effect-transistor, and the current source which is further connected to ground;

the source terminals of the first and second source mirror field-effect-transistors are connected to the input voltage; and the drain terminal of the second source mirror field-effect-transistor is connected to the source terminals of the input and output field-effect-transistors.

9. The low-dropout voltage regulator as claimed in claim 8, wherein the first and second source mirror field-effect-transistors comprise p-channel field-effect-transistors.

10. The low-dropout voltage regulator as claimed in claim 1, wherein the current sink arrangement comprises first and second sink field-effect-transistors wherein:

the first and second sink field-effect-transistors each comprise a gate terminal, a source terminal, and a drain terminal; and the gate terminal of the first sink field-effect-transistor is connected to the drain terminal of the first sink field-effect-transistor, the gate terminal of the second sink field-effect-transistor, and the drain terminal of the input field-effect-transistor;

the drain terminal of the second sink field-effect-transistor is connected to the drain and gate terminals of the output field-effect-transistor and the gate terminal of the pass field-effect-transistor.

11. The low-dropout voltage regulator as claimed in claim 10, wherein the first and second sink field-effect-transistors comprise n-channel field-effect-transistors.

12. The low-dropout voltage regulator as claimed in claim 10, wherein the source terminals of the first and second sink field-effect-transistors are connected to ground.

13. The low-dropout voltage regulator as claimed in claim 1, wherein the error amplifier comprises an operational amplifier.

* * * * *